United States Patent [19]

Murata et al.

[11] 4,173,701

[45] Nov. 6, 1979

[54] SPEAKER DIAPHRAGM MOLDED FROM POLY-BIPHENOL PHTHALATE TYPE RESIN FILM

[75] Inventors: Kosaku Murata, Kobe; Satoshi Takayama, Moriguchi; Hirotoshi Niguchi, Kashihara, all of Japan

[73] Assignee: Matsushita Electric Industrial Co., Ltd., Osaka, Japan

[21] Appl. No.: 836,734

[22] Filed: Sep. 26, 1977

[30] Foreign Application Priority Data

Sep. 30, 1976 [JP] Japan ..... 51-118110

[51] Int. Cl.[2] ..... G10K 13/03

[52] U.S. Cl. ..... 528/194; 181/157; 528/176

[58] Field of Search ..... 260/47 C; 181/157; 528/194, 176

[56] References Cited

FOREIGN PATENT DOCUMENTS 95650 8/1974 Japan ..... 260/47 C

*Primary Examiner*—Lester L. Lee

*Attorney, Agent, or Firm*—Stevens, Davis, Miller & Mosher

[57] ABSTRACT

A speaker diaphragm molded from a poly-bisphenol phthalate type plastic film having ester linkages prepared from an aromatic dicarboxylic acid such as isophthalic acid or terephthalic acid or a mixture thereof and a bifunctional phenol such as bisphenol A. This speaker diaphragm has an excellent low-pitched sound reproducing performance and is further featured by the flat acoustic pressure-frequency characteristic and improved transduce efficiency.

3 Claims, 2 Drawing Figures

SPEAKER DIAPHRAGM MOLDED FROM POLY-BIPHENOL PHTHALATE TYPE RESIN FILM

Figure 1:
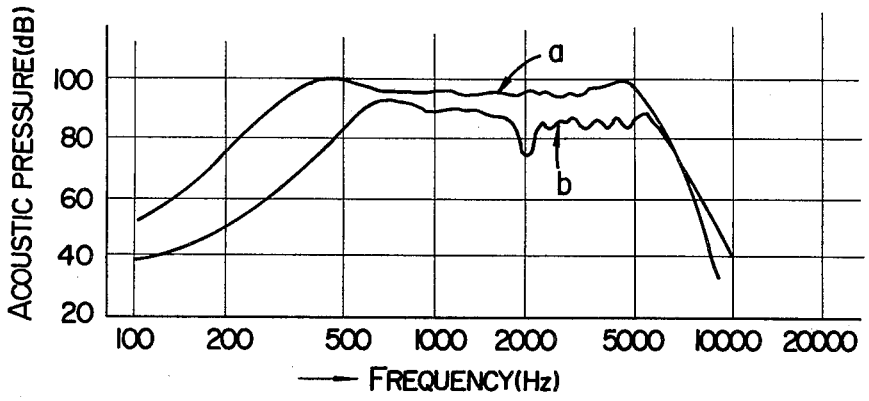

This invention relates to a speaker diaphragm which is most suited for use in the dome or cone type speakers.

There are known in the art several types of speaker diaphragm—paper diaphragm, metal diaphragm and plastic film diaphragm.

Any of these known types of speaker diaphragm, however, has some serious disadvantages. In the case of paper diaphragm, for example, there are required many production steps including paper making step and pressing step and therefore great difficulties attend mass production of such diaphragms. Also, since such paper diaphragm is made of paper, the products vary widely in thickness and weight, making it very difficult to obtain the diaphragms having the desired acoustic characteristics. Further, the paper diaphragm, which has water absorptivity, is liable to change in its acoustic characteristics when exposed to a humid atmosphere and also involves the problem of safety because of flammability.

On the other hand, the metal diaphragm, although substantially free of the problems of flammability and change of acoustic characteristics by humidity, requires drawing in the mold by a hydraulic press or other means when molding into a desired form, so that the obtained products would have non-uniform thickness distribution and also draw marks would remain in the peripheral parts of the products. Further, since the metal diaphragm is small in inner loss, strain might develop during sound reproduction.

The plastic film diaphragm, which has been developed more recently as speaker diaphragm made of a polyvinyl chloride film or polyethylene terephthalate film (for example, "Mylar" (a trade name) film), is improved in the various problems in production as compared with the said conventional paper and metal diaphragms but still has the problem in acoustic characteristics. For instance, the speaker diaphragm made of a polyvinyl chloride film is hardened when exposed to a low temperature below −20° to −30° C., resulting in the badly affected acoustic characteristics, while the diaphragm made of a polyethylene terephthalate film is poor in low-pitched sound reproducing performance.

Generally, the lowest resonant frequency $f_o$ of speaker is given by the following equation:

$$f_o = \frac{1}{2\pi}\sqrt{\frac{s_o}{m_o}}$$

(wherein $s_o$ is stiffness in the diaphragm supporting portion, and $m_o$ is effective mass of the vibration system).

Since the conventional polyethylene terephthalate film was large in elastic modulus, the diaphragm made of such film was high in $s_o$ and hence, as apparent from the above equation, also high in $f_o$, usually about 600 Hz, resulting in poor reproducibility of low-pitched sound. If $s_o$ is lessened by reducing the film thickness of improving the low-pitched sound reproducing characteristic of the polyethylene terephthalate film made diaphragm, divisional resonance is produced in the diaphragm to cause development of strain during reproduction. It was thus difficult to improve the acoustic characteristics of the plastic film made diaphragm.

The present invention have made further studies to improving the properties, particularly acoustic characteristic, of the heretofore known types of speaker diaphragm, particularly plastic film diaphragm, and succeeded in developing a speaker diaphragm having quite satisfactory properties.

An object of this invention, therefore, is to provide a speaker diaphragm which has excellent low-pitched sound characteristics and is flat in acoustic pressure-frequency characteristic and high in transduce efficiency.

Another object of this invention is to provide a fire-retardant speaker diaphragm.

Still another object of this invention is to provide a low-temperature resistant speaker diaphragm.

Yet another object of this invention is to provide a moisture-proof speaker diaphragm.

According to the present invention, there is provided a speaker diaphragm that is molded from a poly-bisphenol phthalate type resin prepared having ester linkage from an aromatic dicarboxylic acid selected from the group consisting of isophthalic acid, terephthalic acid and a mixture thereof, and a bifunctional phenol. In case of using of a mixture of isophthalic acid and terephthalic acid, their molar ratio may be within the range of 1:9 to 9:1.

Figure 2:
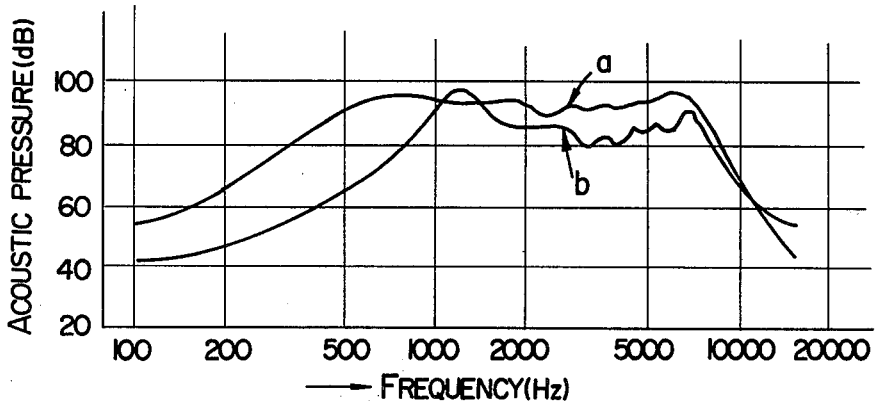

FIG. 1 and FIG. 2 are the acoustic pressure-frequency characteristic diagrams of a speaker diaphragm (a) according to this invention and a conventional speaker diaphragm (Mylar film) (b).

The said poly-bisphenol phthalate type resin film has the basic structure represented by the following formula:

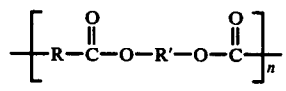

(wherein R is 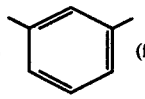 (from isophthalic acid) or

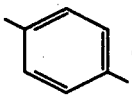 (from terephthalic acid) or a mixture of 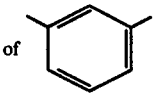 and 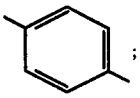 ;

R′ is 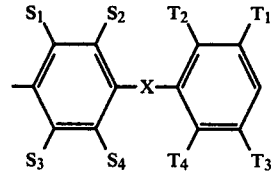 (from bisphenols)

(wherein —X— is —O—, —S—, —$SO_2$— or an alkylene group such as

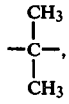

and $S_1$ to $S_4$ and $T_1$ to $T_4$ are hydrogen atoms, halogen atoms, hydrocarbon radicals or the like).

The poly-bisphenol phthalate type resin film according to this invention has elastic modulus in the range of 9,000 to 13,000 kg/cm$^2$, or about half of that (19,000 kg/cm$^2$) of Mylar film, so that the speaker diaphragm obtained from molding such poly-bisphenol phthalate type resin film is small in stiffness and hence low in the lowest resonant frequency $f_o$ and is therefore capable of reproducing a wide range of sound including the low-pitched sound range. Also, since the inner loss of said film is within the range of 0.009 to 0.02, which is large as compared with that 0.005 of Mylar film, the speaker diaphragm molded from said poly-bisphenol phthalate type resin film is "flattened" in the acoustic pressure-frequency characteristic. The specific gravity of said film is around 1.2, which is smaller than that around 1.4 of Mylar film. This proves to be of much account when said film is molded into a speaker diaphragm as it permits a sizable weight reduction of the diaphragm, allowing obtainment of a speaker with high transduce efficiency. Further, said film has excellent heat resistance, the deformation point thereof is around 150° C., and is self-extinguishing as ascertained in the flame resistance tests, so that the speaker diaphragm molded from such film is resistant to high temperature and flame-retardant. Therefore, such film can provide a diaphragm best suited for use in a speaker for which high heat resistance and flame retardancy are required. Another important feature of said poly-bisphenol phthalate type resin film is non-crystallinity. It is to be noted that this film would not be crystallized but stays non-crystalline even if it is exposed in a high-temperature atmosphere for a long period of time. Therefore, this film is not changed in its external appearance and also remains unchanged in its various properties. Such non-crystallinity of the film is advantageous in respect of molding of diaphragms because it allows easier molding than highly crystalline Mylar film and enables mass production of the speaker diaphragm. Moreover, the said film according to this invention is not cured even exposed to a low temperature below about −60° C., so that the diaphragm made of such film is highly proof against deterioration of acoustic characteristics at low temperatures as compared with a diaphragm made of conventional polyvinyl chloride film.

As explained hereabove, the speaker diaphragm made of poly-bisphenol phthalate type resin film according to this invention can produce the following excellent effects as compared with the conventional plastic film diaphragms.

(1) Owing to small elastic modulus of the film, it is possible to lessen stiffness in the diaphragm supporting portion. This makes it possible to lower the lowest resonant frequency $f_o$ to about 300 to 400 Hz, allowing reproduction of low-pitched sounds.

(2) Owing to large inner loss, the flat acoustic pressure-frequency characteristic can be obtained.

(3) As the specific gravity of the film of this invention is relatively low (1.21) as compared with those of Mylar film (1.4) and polyvinyl chloride film (1.35), the speaker adapted with the diaphragm of this invention is high in transduce efficiency as compared with speakers made of conventional plastic film diaphragms.

(4) The film of this invention is not hardened even if it exposed to a low temperature of around −60° C., so that the diaphragm is excellent in low-temperature resistance as compared particularly with a conventional polyvinyl chloride film diaphragm (which is hardened at a temperature of −20° to −60° C.).

(5) As the film of this invention is high in deformation point (around 150° C.) and also has self-extinguishing property, the speaker diaphragm made thereof is flame-retardant and safe in use.

(6) As water absorptivity of the film of this invention is as low as 0.5% as compared with 0.8% of Mylar diaphragm, deterioration of acoustic characteristics by humidity, if any, is negligible.

The invention is now described in further detail by way of some embodiments thereof.

EXAMPLE 1

A methylene chloride solution (with concentration of 50 g/l) of a mixture of isophthaly dichloride and terephthaly dichloride mixed in the molar ratio of 3:7 and an alkaline solution of bisphenol A (with concentration of 40 g/l) were subjected to interfacial polymerization at room temperature to produce a copolymer having logarithmic viscosity of 0.62, and this copolymer was made into chips with diameter of about 2 to 4 mm and length of 3 mm. The logarithmic viscosity of the copolymer was determined by dissolving said copolymer in a phenol/tetrachloroethane mixture (6/4 v/v) to prepare a 1 g/dl solution and measuring the viscosity by Ubbelohde viscometer at 25° C. Said chips had the basic structure represented by the following formula:

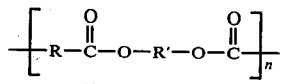

(wherein R is a mixture of

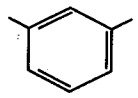

(from isophthaly dichloride) and

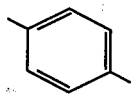

(from terephthaly dichloride) in the ratio of 3:7, and R' is

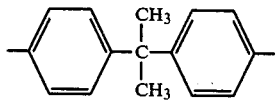

(from bisphenol A).)

The said chips were heated and melt-extruded into a film. The extrusion conditions were as follows:

| | |
|---|---|
| Extruder used: | 25 mm extruder (L/D =20) manufactured by Union Plastic Co., Ltd. |
| Extruding conditions: | Cylinder temperature: 270° C.<br>Die temperature: 280° C.<br>Haul-off roll temperature: 85° C.<br>Haul-off speed: 3.3 m/min. |

The thus produced film had the following physical properties: specific gravity, 1.21; elastic modulus, 9,300 (kg/cm$^2$); inner loss, 0.01; film thickness, 65$\mu$. This film was molded by vacuum molding method to form a cone shaped diaphragm with diameter of 40 mm, height of 2 mm and thickness of 50$\mu$. Curve (a) in FIG. 1 indicates the acoustic characteristic of the speaker using the said diaphragm and curve (b) indicates the acoustic characteristic of the speaker using a cone shaped Mylar film diaphragm having the same diameter and thickness as the diaphragm of curve (a). As apparent from FIG. 1, the speaker using the diaphragm of this invention is low in the lowest resonant frequency $f_o$ owing to low stiffness of the film and also flat in acoustic pressure-frequency characteristic owing to large inner loss of the film.

EXAMPLE 2

The chips same as used in Example 1 were heated and melt extruded by using the same extruder under the same conditions as Example 1 except for a change of haul-off speed to 4.2 m/min to obtain a film. The film thickness was 50$\mu$ due to said change of haul-off speed. This film was vacuum-molded by a method similar to the manner described in Example 1 to produce a cone shaped diaphragm with diameter of 25 mm, height of 3 mm and thickness of 40$\mu$. In FIG. 2, curve (a) shows the acoustic pressure-frequency characteristic of the speaker using the said diaphragm of this invention and curve (b) shows the acoustic pressure-frequency characteristic of the speaker using a Mylar film diaphragm having the same shape, same diameter and same thickness as the said diaphragm of this invention.

As apparent from FIG. 2, the speaker using the diaphragm obtained according to this example of the present invention is low in the lowest resonant frequency $f_o$ owing to low stiffness $s_o$ of the film and also flat in acoustic pressure-frequency characteristic owing to large inner loss of the film.

What is claimed is:

1. A speaker diaphragm having a lowest resonant frequency of about 300 to 400 Hz, molded from a polybisphenol phthalate type resin film having ester linkages prepared from an aromatic dicarboxylic acid selected from isophthalic acid, terephthalic acid and a mixture thereof and a bifunctional phenol, wherein said film has a specific gravity of about 1.2, an elastic modulus of 9,000 to 13,000 kg/cm$^2$, and an inner loss of 0.009 to 0.02.

2. A speaker diaphragm according to claim 1, wherein the aromatic dicarboxylic acid is a mixture of isophthalic acid and terephthalic acid mixed in the ratio of 1:9 to 9:1, and the bifunctional phenol is bisphenol A.

3. A speaker diaphragm according to claim 2, wherein the aromatic dicarboxylic acid is a mixture of isophthalic acid and terephthalic acid mixed in the ratio of 3:7, and the bifunctional phenol is bisphenol A.

* * * * *